US006601276B2

(12) United States Patent
Barber

(10) Patent No.: US 6,601,276 B2
(45) Date of Patent: Aug. 5, 2003

(54) METHOD FOR SELF ALIGNMENT OF PATTERNED LAYERS IN THIN FILM ACOUSTIC DEVICES

(75) Inventor: Bradley Paul Barber, Chatham, NJ (US)

(73) Assignee: Agere Systems Inc., Allentown, PA (US)

( * ) Notice: Subject to any disclaimer, the term of this patent is extended or adjusted under 35 U.S.C. 154(b) by 11 days.

(21) Appl. No.: 09/853,373

(22) Filed: May 11, 2001

(65) Prior Publication Data

US 2002/0166218 A1 Nov. 14, 2002

(51) Int. Cl.[7] ..... H04R 17/00
(52) U.S. Cl. ..... 29/25.35; 310/312; 427/100
(58) Field of Search ..... 29/25.35, 832; 310/311, 312, 313 R; 427/9, 100

(56) References Cited

U.S. PATENT DOCUMENTS

| | | | | |
|---|---|---|---|---|
| 3,864,161 A | | 2/1975 | Thompson | 117/212 |
| 5,373,268 A | | 12/1994 | Dworsky et al. | 333/187 |
| 5,525,527 A | | 6/1996 | Tran | 437/2 |
| 5,873,153 A | | 2/1999 | Ruby et al. | 29/25.35 |
| 5,894,647 A | | 4/1999 | Lakin | 29/25.35 |
| 5,910,756 A | | 6/1999 | Ella | 333/133 |
| 5,929,555 A | | 7/1999 | Sugimoto et al. | 310/360 |
| 5,933,062 A | | 8/1999 | Kommrusch | 333/193 |
| 6,441,702 B1 | * | 8/2002 | Ella et al. | 29/25.35 |

* cited by examiner

*Primary Examiner*—Ehud Gartenberg
*Assistant Examiner*—Peter deVore
(74) *Attorney, Agent, or Firm*—RatnerPrestia

(57) ABSTRACT

The invention relates to manufacturing electromechanical resonators for use in electromechanical filters. Such filters require resonators having different resonant frequencies. Typically all resonators are manufactured having the same resonant frequency and the resonant frequency of selected resonators is altered by the deposition of additional material on selected resonators in the form of additional layers. According to this invention, these layers are formed coextensive with the underlying layers of the resonator by first patterning larger areas of the added material, then masking the patterned areas with masks smaller than the patterned areas and etching both the underlying layer and the patterned area without moving the mask.

25 Claims, 5 Drawing Sheets

50
52
54
51
53

50
52
54
56
51
53

50
52
54'
56
51
53

50
52
54'
51
53

50
52
54'
58
51
53

50
52
60
54"
58
51
53

50
52"
60
54"
58
52'
51
53

50
52"
54"
52'
51
53

METHOD FOR SELF ALIGNMENT OF PATTERNED LAYERS IN THIN FILM ACOUSTIC DEVICES

BACKGROUND OF THE INVENTION

1. Field of the Invention

This invention relates to electrical filters employing a mechanical transducer resonator.

2. Description of Related Art

The need to reduce the cost and size of electronic equipment has led to a continuing need forever smaller filter elements. Consumer electronics such as cellular telephones and miniature radios place severe limitations on both the size and cost of the components contained therein. Many such devices utilize filters that must be tuned to precise frequencies. Hence, there has been a continuing effort to provide inexpensive, compact filter units. One class of filter element that meets these needs is constructed from mechanical resonators such as acoustic resonators. See for example, U.S. Pat. No. 5,910,756 issued Jun. 8, 1999 to Ella.

These devices use acoustic waves, for example, bulk longitudinal waves in thin film material, typically but not exclusively piezoelectric (PZ) material. In one simple configuration, a layer of PZ material is sandwiched between two metal electrodes. The resonator sandwich may be suspended in air, supported along its rim, or may be placed on an acoustic mirror comprised of a plurality of alternating layers of high and low acoustic impedance (the product of speed and density), usually silicon dioxide and aluminum nitride, respectively.

When an electric field is applied between the two electrodes via an impressed voltage, the PZ material converts some of the electrical energy into mechanical energy in the form of sound waves. For certain crystal orientations, such as having the c axis parallel to the thickness of an Aluminum Nitride film, the sound waves propagate in the same direction as the electric field and reflect off of the electrode/air or electrode/mirror interface.

At a certain frequency which is a function of the resonator thickness the forward and returning waves add constructively to produce a mechanical resonance and because of the coupling between mechanical strain and charge produced at the surface of a piezoelectric material, the device behaves as an electronic resonator. The fundamental mechanical resonant frequency is that for which the half wavelength of the sound waves propagating in the device is equal to the total thickness of the piezoelectric plus electrode layers. Since the velocity of sound is many orders of magnitude smaller than the velocity of light, the resulting resonator can be more compact than dielectric cavity resonators. Resonators for 50 Ohm matched applications in the GHz range may be constructed with physical dimensions approximately 100 micrometers in diameter and few micrometers in thickness.

Combinations of such resonators may be used to produce complex filters for band pass applications as disclosed inter alia in the aforementioned U.S. Pat. No. 5,910,756 issued to Ella. This patent describes the use of multiple acoustic resonators in constructing ladder and T type band pass filters. The resonant frequency of the resonator is a function of the acoustic path of the resonator. The acoustic path is determined by the distances between the outer surfaces of the electrodes. When batch producing resonators on a substrate, the thickness of the transducer material and the electrodes is fixed at fabrication; hence, the resultant resonance frequency is also fixed. To change the resonant frequency, material may be added to resonator to increase its thickness.

In manufacturing filters that include a multiplicity of resonators such as a T cell type filter, wherein two resonators have a first resonant frequency and the third has a different resonant frequency, it is often convenient to first produce all three resonators with a single resonant frequency, and add material to one of the three to shift its resonant frequency. This method is not, however without problems. For example, in cases where it is desired to fabricate "T-cell" filters requiring multiple resonators with different resonant frequencies, but on the same substrate, the material for purposes of frequency shifting is often deposited as a continuous layer over all the resonators. This continuous layer is then patterned to leave the desired added material on the one, usually the uppermost, resonator electrode.

While this technique might appear to be straightforward and easy, it is difficult to precisely pattern an added layer to correspond exactly to an underlying previously patterned electrode. A slight shift in the mask results in the creation of a resonator having three regions of differing resonant frequencies as shown in FIG. 3. As illustrated, there is a first region 31 where the electrode is uncovered by the added material, a region 33 where the added material covers the rest of the electrode and a third region 35 where the added material is over the transducer but outside the electrode area. Such structure is undesirable as it introduces parasitic resonance(s) which degrade the filter performance.

There is thus still a need for an improved process to accurately and predictably shift the resonant frequency of resonators by the addition of material, advantageously a process that does not require extremely accurate patterning of the added material.

SUMMARY OF THE INVENTION

There is therefore provided, in accordance with the present invention, a method for adjusting an electromechanical resonator resonant frequency by increasing the total thickness of the resonator which produces a resonator with substantially perfectly aligned resonator layers, thereby avoiding the problems of misaligned layers discussed above.

The simplest resonator form is a sandwich of three layers, a first layer being conductive forming the bottom electrode, an intermediate layer of a transducer material and another conductive layer forming the top electrode. The resonant frequency of this resonator structure may be adjusted by the addition of material over any one of the three layers, most commonly the top electrode which is exposed and readily accessible.

According to the present invention, additional, frequency adjusting material is deposited over the top electrode of a resonator structure and etched so as to form coextensive frequency adjusting and top electrode layers as follows: First, there is formed a patterned area of the frequency adjusting material over the top electrode. Next, the patterned area is masked with a mask having a mask area smaller than the patterned area and being fully contained within the patterned area. After this masking, any material not covered by the mask is removed by etching. The mask remains in place through the etching of both the frequency adjusting material and the top electrode.

This process is particularly useful in cases where more than one resonators are produced side by side and which are later interconnected to form electronic filters. Such resonators are typically all produced simultaneously and all have substantially the same thickness and therefore the same resonant frequency. Using the above process, the three resonator layers are formed as continuous layers. Next a frequency adjusting material is patterned over selected areas of the topmost of the three layers in areas where it is desired to form resonators having a frequency other than the frequency resulting from the three layers alone. Next, masks are placed over both the patterned areas, again fully contained within the patterned areas, and masks are placed outside the patterned areas. Following a subsequent etching step in which the unmasked material is removed, there are simultaneously produced resonator structures of two different resonant frequencies. Again because the masks remain stationary during the etching step, the frequency adjusting layer and the top electrode of the resonator having the frequency adjusting layer form coextensive layers. Therefore, the resulting resonator structure does not exhibit the parasitic resonant frequencies that are encountered in structures produced using the prior art processes.

The above process is not limited to adding frequency adjusting material only to the topmost layer of the resonator structure, but such material may be added to the other layer by altering the order of processing the layers. Thus added material may be placed over the bottom electrode and made coextensive with the transducer layer, under the bottom electrode and made coextensive with the bottom electrode or over the transducer layer and made coextensive with a later deposited top electrode.

BRIEF DESCRIPTION OF THE DRAWINGS

The invention can be more fully understood from the following description thereof in connection with the accompanying drawings described as follows.

DETAILED DESCRIPTION OF THE INVENTION

Figure 1:
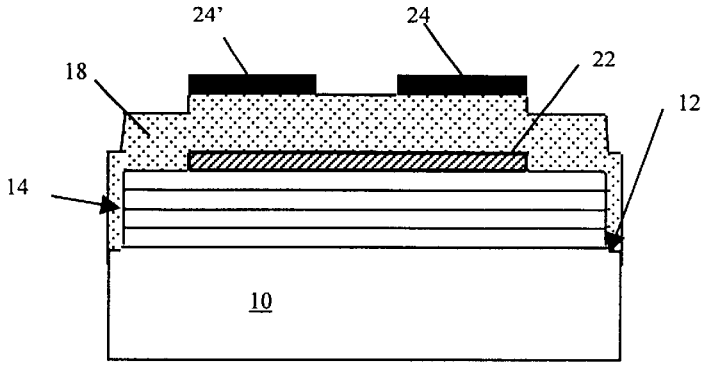
FIG. 1 shows a typical cross section of a finished pair of resonators comprising an acoustic mirror and a piezoelectric resonator.

Throughout the following detailed description, similar reference characters refer to similar elements in all figures of the drawings. Additional layers of insulation, protective films, encapsulation, etc. may be required in particular applications or final products, and all such layers and films have been omitted herein for simplification and better understanding of the invention. The specific structure and fabrication methods illustrated are for exemplary purposes only.

In describing this invention an electromechanical resonator structure is used by way of illustration. While specific methods of manufacturing are disclosed herein, other methods of fabricating a resonator, filter, or similar multi-layer structure in accordance with the present invention can be devised including but not limited to substrate etching, adjustment layers, reflecting impedance matching layers, etc. U.S. Pat. No. 5,373,268, issued Dec. 13, 1994, with the title "Thin Film Resonator Having Stacked Acoustic Reflecting Impedance Matching Layers and Method", discloses a method of fabricating thin film resonators on a substrate.

Referring now to FIG. 1, there is shown a typical structure of two mechanical resonators on a common support of the type used in forming an electrical filter. The resonator structure comprises a substrate 10 having an upper planar surface 12. Substrate 10 can be any convenient material that is easily workable, e.g. any of the well known semiconductor materials. In the present specific example, substrate 10 is a silicon wafer normally used for fabricating semiconductor products. Other materials useful as resonator supports include, inter alia, glass, quartz, sapphire or high resistivity silicon.

In the example illustrated in FIG. 1, a plurality of alternating layers of $SiO_2$ and AlN, ending with a $SiO_2$ uppermost layer, form an acoustic reflective mirror 14. Each of the mirror layers has a typical thickness that is a ¼ wavelength of the filter's central frequency. For PCS cellular phone applications this frequency is 1.9 Gigahertz.

The use of an acoustic mirror of course, is not the only way to make a resonator. What is needed, and what the acoustic mirror provides, is good acoustic reflection at the boundaries of the transducer layer. Other techniques to achieve this are known in the art, including using a solid to air interface. Air against most solids produces the required acoustic reflection. For example, one can also make an acoustic resonator by thin film deposition of the resonator material on a substrate of Si and subsequent removal of the layers beneath the resonator by: a) back etching away the Si or b) deposition of a sacrificial layer beneath the resonator which is removed by subsequent preferential etching. The present invention is directed to resonator tuning and applies to all resonators regardless of their structure.

A bottom electrode (22), which may be patterned to define distinct electrodes for each resonator structure, (not shown) or may be a common bottom electrode (shown in FIG. 1), is deposited and patterned (if required) on the surface of the acoustic mirror. A mechanical transducer layer 18, such as a piezoelectric layer, is next coated over the bottom electrode. In most applications, the piezoelectric layer is coated as a continuous conforming layer over the bottom electrodes, the acoustical mirror, if present, and the support.

An outer layer of this structure forms electrodes 24 and 24' and completes the basic resonator structure. The outer layer term as used in this description preferably forms an electrode. Electrodes may be constructed both as single conductive layer electrodes and/or electrodes comprising more than one layers at least one of which is conductive. For purposes of this invention the specific structure of the outer layer is not particularly significant as long as it is a layer offering an exposed surface on which additional material may be deposited and as long as it can be selectively etched, as described below, to form patterned areas.

The manner of fabrication of the above described layers and resonator structure is well known in the resonator fabrication art. The different layers can, for example, be fabricated utilizing any of the well known techniques, such as, vacuum deposition of a convenient material, electroless deposition, etc., followed by masking and etching to created desired patterns. In FIG. 1, the transducer layer 18 is shown as a continuous layer, however this layer may, depending on the particular application, be masked and etched so that it exists only between the top and bottom electrode defined areas.

A plurality of individual piezoelectric resonators of the type shown in FIG. 1 are fabricated on a single wafer and, since each resonator is relatively small (on the order of a few hundred microns on each side) and the plurality of resonators are formed close together, each resonator will be very similar to each adjacent resonator. A required number of piezoelectric resonators are fabricated on a single substrate or wafer and electrically connected to form a desired piezoelectric filter configuration. The electrical connections are typically patterned on the wafer at the same time that outer layers (typically electrodes) 24 and 24' are patterned on the wafer.

Because piezoelectric materials are the most commonly used transducer materials, we describe this invention using a piezoelectric material for the transducer. Such use is not, however, intended to limit the invention to piezoelectric transducers. Other transducers such a magnetostrictive or electrostrictive may equally well be used in filter designs and the teachings of this invention apply equally well to structures that incorporate different transducer materials. What is significant is that the transducer material used results in a resonator having a resonant frequency that is dependent on the overall thickness of the resonator, which thickness includes both the transducer thickness and the electrode thickness.

Figure 2:
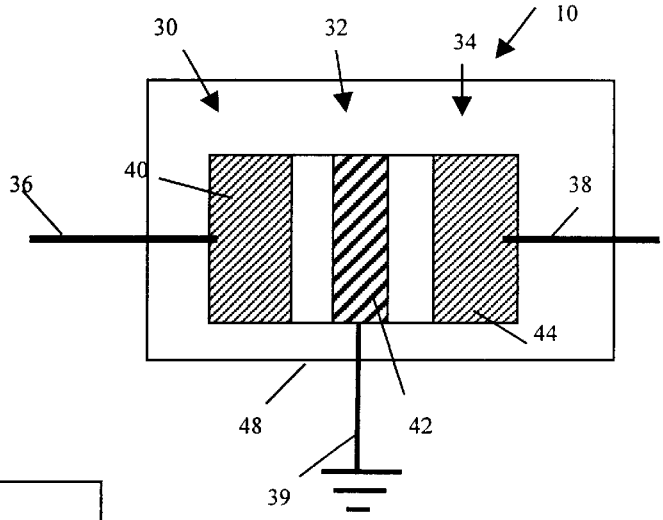
FIG. 2 shows a top view of a three resonator structure forming a T band pass filter.

FIG. 2 is a top view of a basic T-cell type filter structure utilizing three resonators, 30, 32, and 34. A three resonator T-cell filter structure is a simple case used for illustrating the present invention. Other, more complex designs are also well known in the art. Frequently, many T-cells are concatenated to form more complex filters. There are also lattice filters, and "L" filters. The present invention is applicable in all cases, and is not limited to T-cells.

In cases where there are more than two resonators present in a filter structure, there may be more that two resonant frequencies to which resonators must be tuned. The present invention may be used to generate more than two different frequencies by using selective etching techniques to selectively pattern different materials in the presence of others. The two frequencies discussed herein are used only to illustrate this invention.

Each resonator in FIG. 2 has the structure of the resonators shown in FIG. 1. A T-cell filter structure can thus be achieved by providing through wire 36 an input connection to the resonator 30, and through wire 38 an output. The shunt resonator 32 is connected to common or ground through wire 39. Bottom electrode 22 (FIG. 1) serves as the common point between all resonators. In this example, resonators 30 and 34 are designed to have the same resonant frequency while resonator 32 has a different resonant frequency. To obtain this difference in frequency the total electrode/transducer combined thickness is the same for resonators 30 and 34 but different (higher for bandpass filters) for resonator 32.

In order to facilitate the batch manufacture of the resonators, it is advantageous to initially form the bottom electrode and the piezoelectric layer with the same thickness for all three resonators and vary their resonant frequencies by varying the thickness of the top electrodes 40, 42 and 44. In this example electrodes 40 and 44 have the same thickness while electrode 42 is thicker.

To obtain the different thickness in electrode 42, additional material in the form of a thickness adjusting material has been added to the outer layer of this resonator. Because the thickness adjustment also adjusts the resonant frequency of the resonator, we refer to this deposited material as the frequency adjusting layer.

Figure 3:
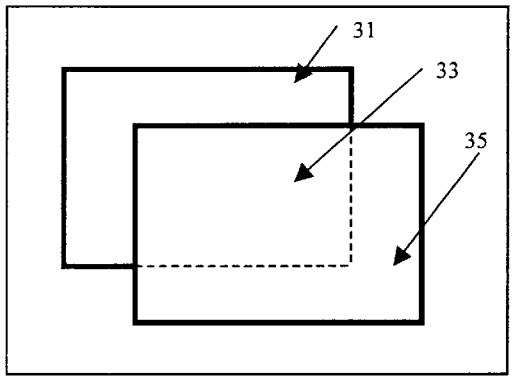
FIG. 3 PRIOR ART.
FIG. 3 shows a top view of the outer layer of a resonator to which has been applied an added thickness adjusting layer for altering the resonant frequency of the resonator according to the prior art.

FIG. 4 schematically illustrates the process steps according to the invention, for adding additional resonant thickness adjusting material to an outer layer of a resonator, without creating a structure as illustrated by FIG. 3. An additional advantage of the process is that the transducer layer in the regions that become resonators is never exposed to etchants. FIG. 4 shows only two resonators. In the case of a T-cell type filter a third resonator would be manufactured identical and simultaneously with the second, thinner resonator.

Figures 4A, 4B, 4C, 4D, 4E, 4F, 4G, 4H:
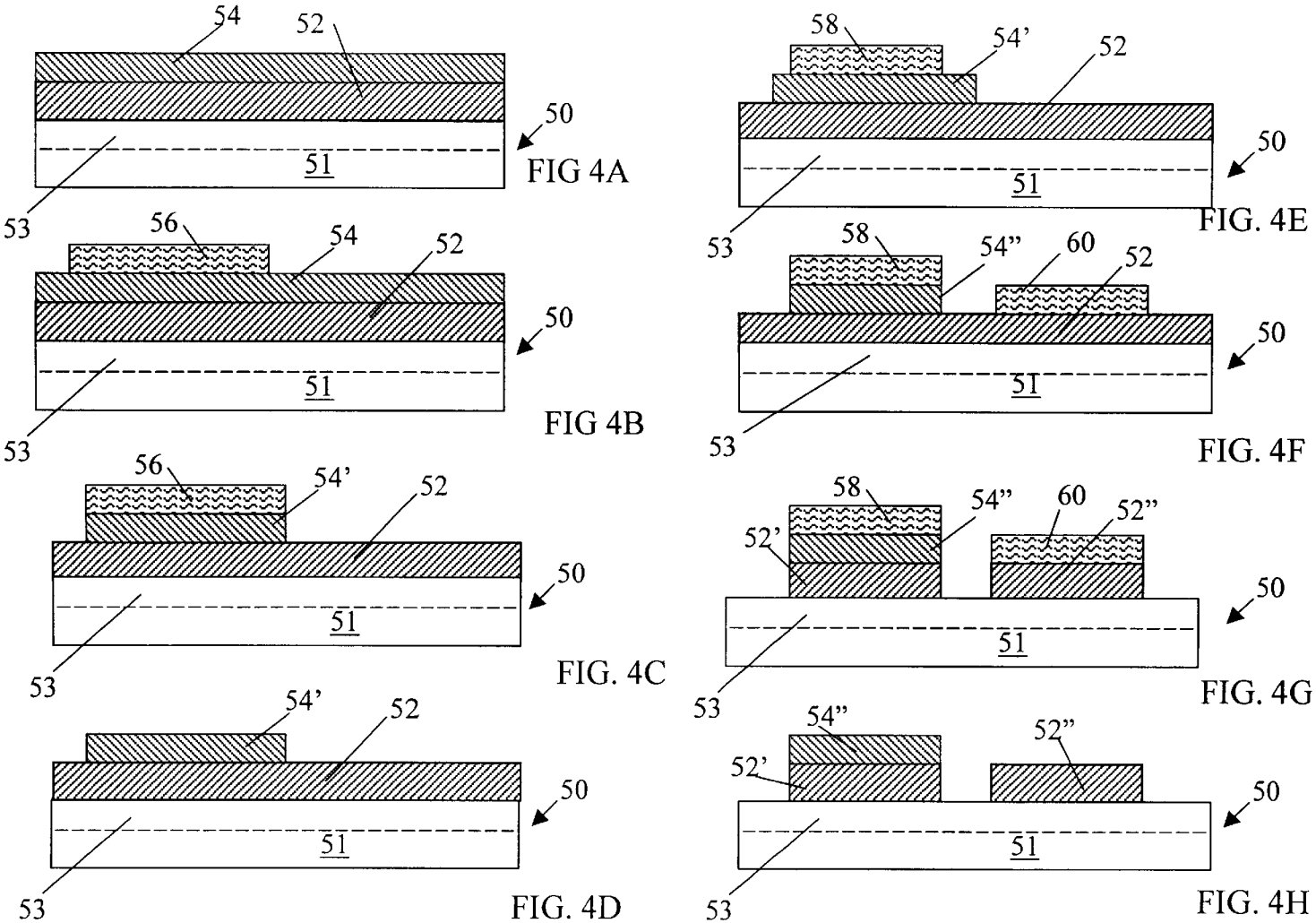
FIGS. 4A–4H show in schematic elevation representation the manufacturing steps according to the present invention to add a frequency adjusting layer during the manufacture of a multi-layer structure to one of two adjacent resonators.

FIG. 4A shows an outer layer 52 of a resonator structure 50 having a number of layers thereunder. In the case of a resonator structure, these layers will comprise at least a bottom electrode layer 51 and a transducer layer 53. On the outer layer 52, there has been formed according to this invention an additional, frequency adjusting layer 54 of a suitable material to increase the total thickness of the resonator by an amount that shifts the resonant frequency to a desired frequency.

As illustrated in FIG. 4B, a first mask 56 is next placed over a portion of the added thickness adjusting layer 54 in the area where the resonator with the adjusted resonant frequency is located. The area masked by this first mask 56 is larger than the desired final area of the resonator.

In the next step illustrated in FIG. 4C the unmasked portion of the frequency adjusting layer 54 is selectively etched in a first etch. What is meant by selectively etched is that the added material is etched using a process which only etches the added material layer 54 and does not etch to any substantial degree the underlying outer layer 52. For example, layer 52 may a titanium layer while layer 54 may be aluminum. The aluminum layer may be etched in the unmasked areas using a Phosphoric/Acetic/Nitric acid which will not attack the underlying Titanium layer.

Next the mask 56 is removed leaving a first patterned added thickness adjusting layer 54' over the outer layer 52, as shown in FIG. 4D. A second mask 58 corresponding to the final area of the resonator with the adjusted resonant frequency, is next applied over the patterned layer 54'. As shown in FIG. 4E, the area of the mask 58 is smaller than, and fully contained within the first patterned area.

A second etching step is next performed in which the first patterned area is etched to a second patterned area which is equal to the design area for the resonator of this filter, as shown in FIG. 4F. At this stage another mask 60 may be placed over outer layer 52, typically adjacent the mask 58, sized to produce another resonator having a different resonant frequency for use in a filter structure. Alternatively, though not illustrated, the mask 60 may be deposited on the outer layer at the same time mask 58 is placed on the first patterned area 54'. In either case, after the second etch the resonator looks the same as shown in FIG. 4F.

Next, a third etching step is performed in which the unmasked areas of the outer layer 52 are removed. If, as mentioned earlier, this layer is Titanium, etching may be EDTA Peroxide which will etch the titanium but not the Aluminum. Following this second etching, the unexposed areas of the outer layer are removed forming patterned areas 52' and 52", as shown in FIG. 4G. As shown, patterned area 54" is identical and coextensive with patterned area 52' because both areas were created using the same mask and without any movement of the mask between etching steps.

The final step is the removal of masks 58 and 60 leaving behind the structures illustrated in FIG. 4H comprising two resonators each with a distinct resonant frequency, which can be interconnected to form desired filter structures.

An alternate embodiment of this process is illustrated in FIGS. 5A–5I. In this case the transducer layer in some regions which will end up as resonators is exposed to the etchants, but the criteria of selective etching between outermost layer and frequency shifting, thickness adjusting layer may be relaxed.

Figure 5A:
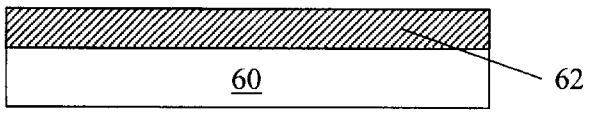
FIGS. 5A–5I show in schematic elevation representation the manufacturing steps according to an alternate embodiment of the present invention.
Figure 5B:
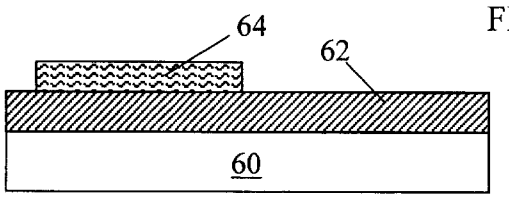
Figure 5C:
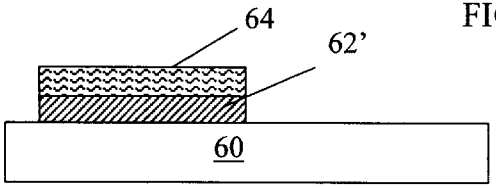
Figure 5D:
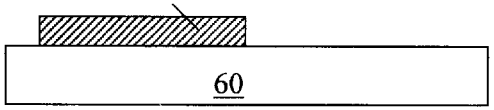
Figure 5E:
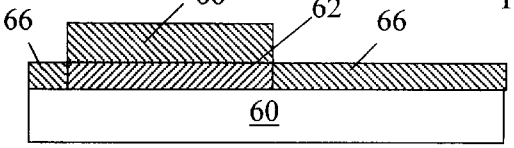

As shown in FIG. 5A there is first deposited on a transducer layer 60 of a resonator, an original outer or top layer 62, which may be conductive, thereby forming one of the two electrodes of the resonator. (The second electrode is typically under the transducer layer 60 and not shown in the figures to prevent cluttering. Next, as shown in FIG. 5B, the outer layer is masked with mask 64 and etched to form a patterned area 62' shown in FIG. 5*c*.

Figure 5F:
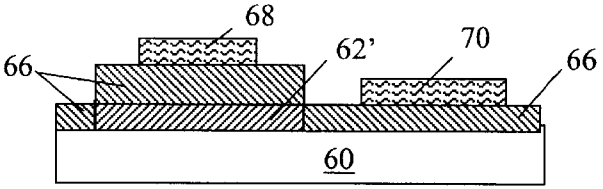
Figure 5G:
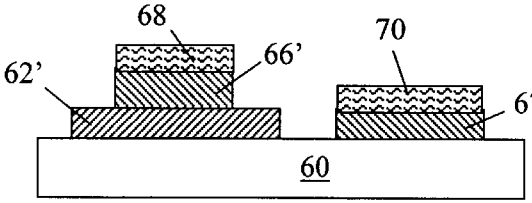

An added, frequency adjusting layer 66 is next applied over the patterned area 62' and the resonator layer 60. A second mask 68 having an area which is smaller than the patterned area 62' is applied over added layer 66 over the patterned area 62' as shown in FIG. 5F, to form the resonator whose frequency is being adjusted. If desired, a third mask 70 for another resonator whose frequency is not being adjusted is also placed over layer 66. The unmasked portions of layer 66 are next etched away, producing the structure shown in FIG. 5G.

Figure 5H:
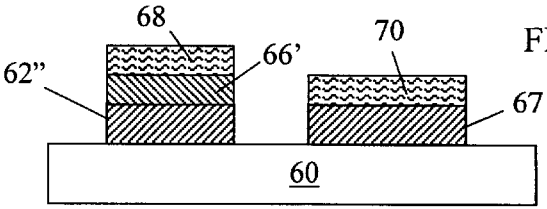
Figure 5I:
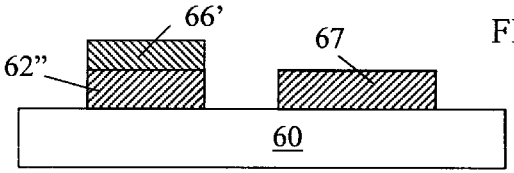

A third etching step is next used to remove the unmasked areas of patterned area 62'. As patterned area 62' is larger than the area masked by mask 68 and patterned area 66', and masked by both, etching of the exposed portions of area 62' leaves behind a patterned area 62" substantially identical and co-extensive with area 66' as shown in FIG. 5H. Removal of the masks 68 and 70 follows, to produce a resonator whose frequency has been adjusted by the substantially coextensive addition of a patterned thickness adjusting material on its previously patterned original outer layer.

According to yet another embodiment of this invention illustrated in FIGS. 6A–6E, an added frequency adjusting layer 72 is first deposited on a transducer layer 70. As previously this layer 70 is typically placed over a lower electrode not illustrated. A mask 74 is placed over layer 72 in the area where the resonator having the desired adjusted frequency is being built. Mask 74 has a larger area than the final area of this resonator. Layer 72 is next etched away in a first etching step, producing the structure shown in FIG. 6B, where the non etched portion of the frequency adjusting layer 72 is shown as area 73.

Figure 6D:
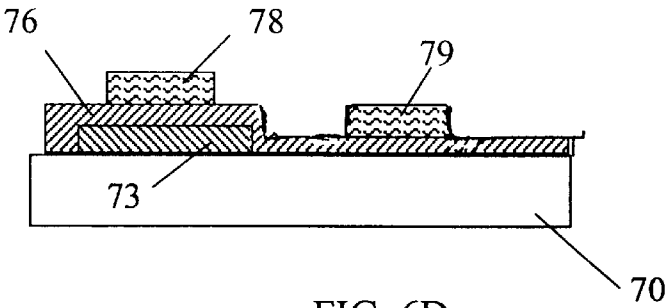
FIGS. 6A–6E show in schematic elevation representation the manufacturing steps according to a second alternate embodiment of the present invention.
Figure 6E:
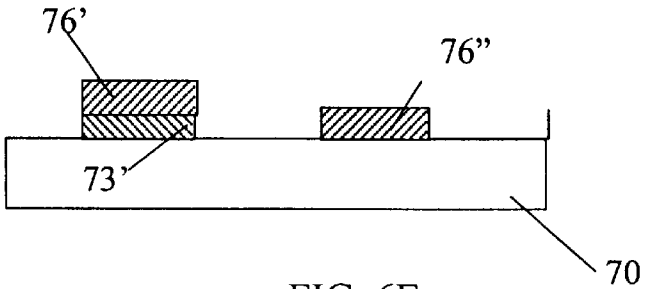
Figure 6A:
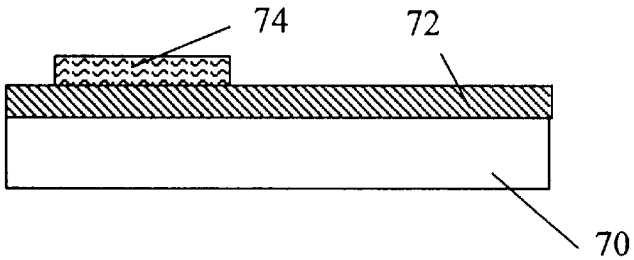
Figure 6B:
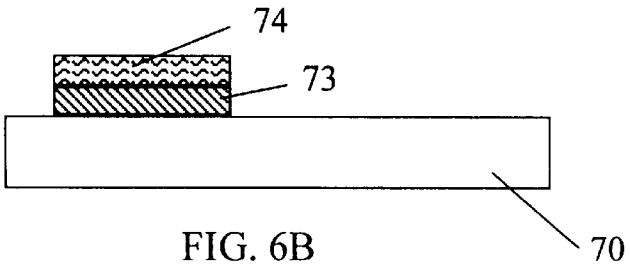
Figure 6C:
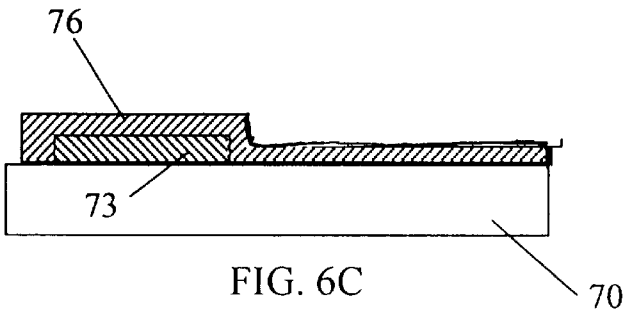

The mask 74 is next removed and a layer 76 is comformably coated over the exposed surface of layers 70 and 73 as shown in FIG. 6C. Layer 76 is preferably conductive so that following patterning will form one of the two electrodes of the resonator.

Layer 76 is next masked with mask 78 defining an area larger than the patterned area 73 positioned over and completely within patterned area 73. Optionally, a second mask 79 is used to form a second resonator having a different design resonant frequency. Both resonators may be connected to form a filter structure.

A second etching step is next used to remove both the uncovered portions of layer 76 and patterned area 73, producing two resonators with different thickness and therefore different resonant frequencies. The etching step may be a single etching step removing both exposed portions of patterned area 73 and layer 76, or as before may be a two step process selectively removing layer 76 first and layer 73 in a second step. In either case the end result is a structure in which there are patterned areas 73' and 76' that are overlapping and coextensive forming a first frequency resonator and if desired one or more adjacent resonators having the patterned area 76" as its upper electrode and a different resonant frequency.

In the typical case where this process is used to fabricate electromechanical filters comprising multiple resonators having different resonant frequencies, layer 50 and layer 60 is a transducer layer deposited over a conductive substrate (not shown) which forms a first electrode of the resonators. In such case, layers 52, 62 and 76 are, preferably, conductive layers and form the second electrode. The resonant frequency is dependent on the combined thickness of these three layers. The frequency adjusting layers (54, 66 and 76 as the case may be) are used to change the overall thickness of any one or more resonators and thereby the resonant frequency of this resonator. These layers can be conductive or nonconductive, conductive being a preferred choice.

In addition to using titanium and aluminum for the two layers 52 and 54, 62 and 66, or 72 and 76, respectively, other combinations may be used, preferably combinations that permit the selective etching of the layers described above. Thus, for example, layer 52 (or 62) may be aluminum, and layer 54 (or 66) may be $SiO_2$, or layer 54 (or 66) may be gold. In the manufacturing processes shown in FIGS. 5 and 6 it is also contemplated according to the present invention to use similar materials for the two layers, or materials that are etched in the same etchant, and to have the second etching step be a single step removing both layers unmasked areas at once.

If the resulting topmost layer 54 (or 66) of a resonator is non-conducting such as in the case of $SiO_2$, a small exposed region of the underlying layer 52 may need to be provided for good electrical contact (not shown in the Figures). Preferably, this electrical connection can be made just outside the edge of the resonator by leaving a small region of layer 52 (or 66) outside of the boundary of design area 54" (or 62") by using an appropriate designed mask to provide protection of a small area of the outer layer 52 (or 62) outside the design area covered by the mask 58 (or 68).

Optionally, the outer layer may be deposited in a single step over all resonators. Additional material is then placed on the portions of the outer layer where it is desired to form resonators with different resonant frequencies.

The frequency adjusting layer may be deposited in a single deposition or may be built gradually by the sequential deposition of multiple layers. Depending on the process selected, masking and etching of the layers may be performed after a desired thickness has been achieved, or may be performed as each layer is deposited. In the latter case, each layer is masked with increasingly smaller area masks always fully contained within the preceding etched first area of the added layers. After full thickness is achieved, the final mask is used to define the final design area and all preceding exposed portions of the thickness adjusting layers underneath are etched away resulting in multiple coextensive superposed layers.

Removal of the unmasked portions of a layer may be done by etching the exposed material using dry etching as described above. Reactive ion etching is sometimes preferred because it provides excellent materials selectivity. However other etching techniques can be applied within the scope of this invention.

Wet etching by dipping the parts in solution offers the advantage of speed and can also be used to practice this invention. In such case, a measurement of the resonator frequency is made prior to dipping the resonator in an etching bath. A subsequent timed immersion removes desired amounts of material. For example, in a structure with three resonators where three different resonant frequencies are desired, the topmost layer of the three resonators may be respectively titanium, gold and aluminum. The baths then may be EDTA Peroxide to etch the titanium, PAE etch for the aluminum, and potassium iodide/iodine for the gold electrode.

Vapor phase etch is another possible process and tools exist and can be used. Similar chemistry to the wet etch example above can be used, and in this case active measurement of the resonant frequencies may be done concurrent with the etching process without loading the resonator. A vapor phase etching apparatus resembles an RIE chamber in that it has gas handling and vacuum inputs and outlets to introduce chemical vapor and pump away the by products, but does not include a plasma source. An advantage to vapor phase over RIE is etch speed.

In a filter that comprises a plurality of resonators, such as the three resonator T-cell filter shown in FIG. 2, and wherein the top electrode is aluminum and the thickness adjusting layer comprises an $SiO_2$ layer, the $SiO_2$ layer may be etched in a vacuum chamber, first using fluorine ions. Chlorine is next introduced in the chamber and etching of the aluminum follows.

When such process is used, once the resonator has been formed, fine tuning may be performed by removing the masks 58 and 60 shown in FIG. 4F and further etching either the $SiO_2$ layer or the Aluminum layer while applying a test signal to these resonators and monitoring the resonant frequency. When the resonant frequency is reached for the resonators with the $SiO_2$ top layer, the fluorine etching process is terminated. The process is next repeated for the resonators with the aluminum top layer. Thus both resonators can be adjusted to proper different frequencies with high accuracy and without need to mask or move the sample during the process.

Etching is well known technology not requiring further discussion herein, as shown by the following two treatises: Vossen and Kern, *Thin film processes;* Academic Press, San Diego 1978 and by the same authors, *Thin film processes II,* Academic Press, San Diego 1991.

The frequency adjustment described above has been described with examples where the outermost layer to which the thickness adjusting layer is either the transducer or what is typically referred to as the outer or top electrode of the resonator. This however is not necessarily always the case. A thickness adjusting layer may be placed under the transducer layer between a patterned bottom electrode as shown in FIGS. 7A–7E.

Figure 7D:
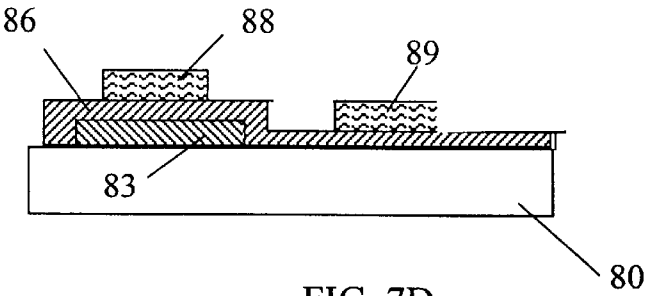
FIGS. 7A–7E show in schematic elevation representation the manufacturing steps according to a third alternate embodiment of the present invention.
Figure 7E:
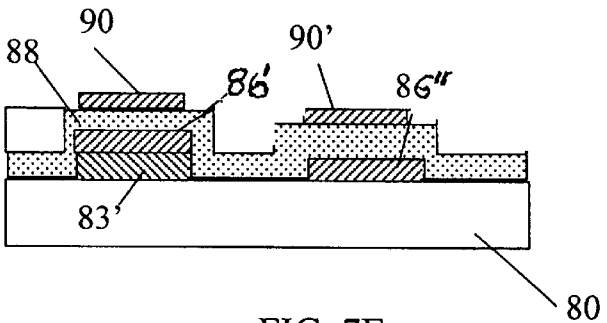
Figure 7A:
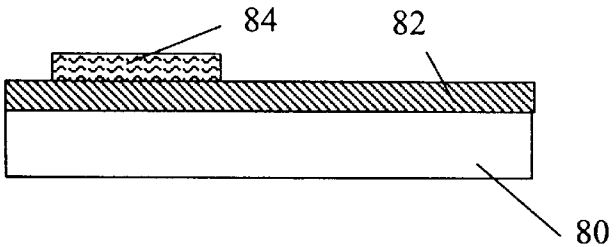
Figure 7B:
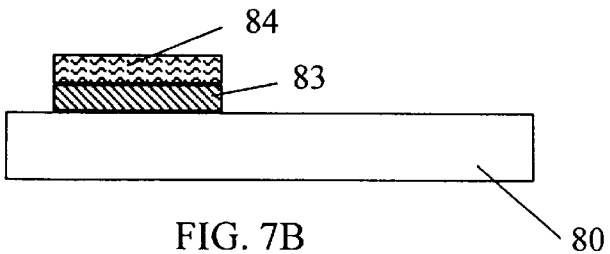
Figure 7C:
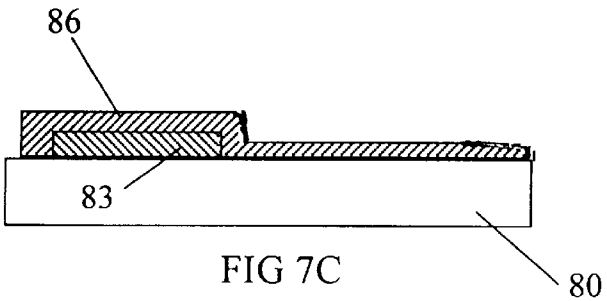

In this case a thickness adjusting material is first formed as layer 82 on a proper resonator support 80 as shown in FIG. 7A. This layer is then masked with a first mask 84 having an area larger than a desired final resonator area and the exposed areas of layer 82 are etched away to form a first patterned area 83 as shown in FIG. 7B. A conductive layer 86 is next placed over both patterned area 83 and support 80 as shown in FIG. 7C. Layer 86 is next masked with a mask 88 having an area smaller than the patterned area 83 placed over and fully within area 83. Optionally a second mask 89 may be used to simultaneously form a bottom electrode of an adjacent resonator having a different resonant frequency, if so desired. Layer 86 and patterned area 83 are next etched where exposed producing coextensive layers 83' and 86', as well as a bottom electrode 86" for an optional additional resonator where desired.

The remaining steps are typical well known process steps for producing resonators, and involve the deposition of a transducer layer 88 over the patterned areas 86' and 86" and forming top or outer electrodes 90 and 90'.

The supporting resonator layers which are not illustrated may comprise an acoustic mirror. In the alternative, following the steps for making the resonators described above, there may be performed additional steps to form a cavity under the resonator.

The invention has heretofore been described with reference to specific materials and etching processes particularly describing applications of the process in the fabrication of electromechanical filters. Such description is only for the purpose of explaining the invention and the person skilled in the art will recognize that the invention is equally applicable where single or multiple resonators not part of any filter are manufactured. Similarly the person skilled in the art will recognize that there are alternate ways to practice this invention. The materials and etching processes disclosed are disclosed by way of illustration only and are not limiting of the invention.

While the invention has been described applied to piezoelectric resonators, the same principles may be applied in other applications where the deposition of patterned layers with a high degree of registration to form co-extensive overlapping areas is essential, and where etching away unmasked portions of the overlapping layers is practical.

I claim:

1. A method for fabricating a device, the method comprising:

a. forming an outer layer of a resonator comprising a bottom layer, a transducer layer and said outer layer;

b. forming a first patterned area of a thickness adjusting material over said outer layer of said resonator, c. masking said first patterned area of said resonator with a mask having a mask area smaller than said patterned area and being fully contained within said first patterned area, and;

d. forming coextensive outer and thickness adjusting layers for said resonator by etching any thickness adjusting material and any outer layer not covered by said mask.

2. The process according with claim 1 wherein said outer layer and said thickness adjusting material have different etch properties and are etched sequentially without moving said mask.

3. The process according to claim 1 wherein after forming said outer layer, and before performing step (b), said outer layer is etched to form an outer layer patterned area, said outer layer patterned area being larger than said first patterned area and wherein in step (6) said first patterned area is formed fully contained within said outer layer patterned area.

4. The process according to claim 1 wherein at least one of said outer layer and thickness adjusting material is conductive.

5. The method according to claim 1 wherein following step (d) there is performed a step e) of removing said mask.

6. The method of claim 1 wherein said outer layer comprises a material selected from the group consisting of Al, $SiO_2$, Ti, and Gold, wherein said thickness adjusting material comprises a material selected from the group consisting of Al, $SiO_2$, Ti, and Gold, and wherein said outer layer material and said thickness adjusting material are selected to exhibit different etching properties.

7. The method of claim 1 wherein the step of depositing a thickness adjusting material over said outer layer comprises depositing said thickness adjusting material to a thickness calculated to produce a desired resonant frequency in said resonator.

8. A method for fabricating a device the method comprising:

a. forming an outer layer of a resonator comprising a bottom layer, a transducer layer and said outer layer;

b. forming a first patterned area of a thickness adjusting material over said outer layer of said resonator, c. placing a first mask over said first patterned area of said resonator the mask having a mask area smaller than said patterned area and being fully contained within said first patterned area;

d. placing a second mask over said outer layer outside said patterned area; and e. forming coextensive outer and thickness adjusting material layers for said resonator by etching any thickness adjusting material and any outer layer not covered by said masks thereby forming a first and a second resonator having different resonant frequencies.

9. The method according to claim 8 wherein following step (e) there is performed an additional step of removing the masks.

10. The method according to claim 8 wherein steps (b), (c) and (d) comprise forming more than one patterned areas and placing more than one first and second masks within and without said patterned areas respectively, thereby to form after step (e) a plurality of different resonant frequency resonators.

11. The method according to claim 8 further comprising electrically connecting said first and said second resonators to form a filter.

12. A method for fabricating a device, the method comprising:

a. forming a transducer layer of a resonator comprising a bottom layer, said transducer layer and an outer layer;

b. forming a frequency adjusting layer over said transducer layer, said frequency adjusting layer having a first thickness;

c. patterning said frequency adjusting layer to form a first patterned area of said resonator over said transducer layer;

d. depositing said outer layer over said first patterned area and said transducer layer;

e. placing a mask over said outer layer over said first patterned area, the mask having a mask area smaller than said first patterned area, and the mask area being fully contained within said first area;

f. forming superposed substantially co-extensive patterned areas of said outer layer and said frequency adjusting layer by etching without moving the mask any areas of said outer layer and said frequency adjusting layer not covered by said mask; and i. removing said mask.

13. The method according to claim 12 wherein said frequency adjusting layer comprises a same transducer material as the transducer layer.

14. The method of claim 12 wherein said outer layer comprises a conductive material and forms an outer electrode of said first resonator.

15. The method of claim 14 further comprising in step (e), placing at least one other mask on said outer layer elsewhere than over the first patterned area, and in step (f) etching all said unmasked areas thereby forming an outer electrode of at least one second resonator, said second resonator having a resonant frequency different from said first resonator frequency.

16. The method according to claim 15 further comprising electrically connecting said first and at least one of said at least one second resonators to form a filter.

17. A method for fabricating a device:

a. forming a frequency adjusting layer on a support;

b. patterning said frequency adjusting layer to form a first patterned area of said device over said support;

c. forming a first conductive layer over said first patterned area;

d. placing a mask over a portion of said first conductive layer that lies over said first patterned area, the mask having a mask area smaller than said first patterned area, and the mask area being fully contained within said first area;

e. forming superposed substantially co-extensive patterned areas of said conductive layer and said frequency adjusting layer by etching without moving said mask, any areas of said frequency adjusting layer and said first conductive layer not covered by said mask;

f. removing said mask;

g. forming a transducer layer over said superposed substantially coextensive patterned areas of said device; and h. forming a second conductive layer over said transducer layer.

18. The method according to claim 17 further comprising:

in step (d) also placing at least one other mask over a portion of said first conductive layer that lies outside said first patterned area, and etching any areas of said first conductive layer not covered by said at least one other mask, to form at least two resonators having different resonant frequencies.

19. The method according to claim 18 further comprising electrically connecting said at least two resonators to form a filter.

20. A method for fabricating a device, the method comprising:

a. forming an outer layer of said device;

b. depositing a frequency adjusting layer over said outer layer;

c. patterning said frequency adjusting layer to produce a first patterned area of said device over said outer layer;

d. repeating steps (b) and (c) at least once, each time depositing an additional frequency adjusting layer and forming an additional patterned area over a preceding patterned area smaller than said preceding patterned area and fully within said preceding patterned area of said device to form an outermost area of said device;

e. placing a mask over said outermost area, said mask having an area smaller than and being fully contained within said outermost area;

f. forming superposed substantially co-extensive patterned areas of said outer layer and said frequency adjusting layer by etching without moving the mask, any unmasked areas of said frequency adjusting layers and said outer layer, and g. removing said masking.

21. The method of claim 20 wherein said first outer layer comprises a conductive material and said device is an adjusted resonator.

22. The method of claim 21 further comprising placing at least one other mask over said outer layer in an area other than said patterned areas prior to step (f) whereby following etching in step (g) there is formed at least one additional resonator having a frequency other than the adjusted resonator.

23. A method for fabricating a device, the method comprising:

a. forming a first conductive layer over a resonator support structure;

b. forming a transducer layer over said first conductive layer;

c. forming a second conductive layer over said transducer layer;

d. wherein said first conductive layer, said transducer layer and said second conductive layer have a first combined thickness;

e. depositing a frequency adjusting layer having a thickness over said second conductive layer to form a second combined thickness with said first conductive layer, said transducer layer and said second conductive layer;

f. patterning said frequency adjusting layer to produce a first patterned area on said second conductive layer and to expose said second conductive layer outside said first patterned area;

g. placing a first mask defining a final first transducer area smaller than said first patterned area over said first area, and placing a second mask defining a final second transducer area over said exposed second conductive layer;

h. forming substantially superposed and co-extensive patterned areas of said outer layer and said frequency adjusting layer for said first resonator by etching, without moving the first and second masks, any unmasked areas to sequentially remove said frequency adjusting layer and said second conductive layer in the unmasked areas, wherein said etching forms said first resonator comprising said frequency adjusting layer, said first conductive layer, said transducer layer and said second conductive layer with superposed substantially co-extensive patterned areas of said outer layer and said frequency adjusting layer, and further forms said second resonator comprising said first conductive layer, said transducer layer and said second conductive layer;

i. removing said masks; and j. electrically connecting said first and said second resonators.

24. The method according to claim 23 further comprising forming an acoustic reflector structure under at least one of the resonators.

25. The method according to claim 23 further comprising forming a cavity under at least one of the resonators.

* * * * *